United States Patent [19]

Bachi

[11] 3,989,200

[45] Nov. 2, 1976

[54] NON-CIRCULAR PERFECT LAYER ELECTRICAL COILS

[75] Inventor: Robert W. Bachi, Itasca, Ill.

[73] Assignee: Bachi, Inc., Itasca, Ill.

[22] Filed: Apr. 22, 1975

[21] Appl. No.: 570,477

[52] U.S. Cl. ..... 242/7.03; 242/7.13; 242/117; 242/118.4; 336/189

[51] Int. Cl.[2] ..... H01F 41/06; H01F 27/28; B65H 75/14

[58] Field of Search ..... 242/7.13, 118.4, 118.7, 242/117, 7.03; 336/196, 197, 189, 190, 191, 209

[56] References Cited

UNITED STATES PATENTS

| | | | |
|---|---|---|---|
| 3,109,601 | 11/1963 | Van Der Hoek et al. | 336/190 X |
| 3,480,229 | 11/1969 | D'Entremont | 242/118.4 |
| 3,851,830 | 12/1974 | Barthalon | 336/189 |

*Primary Examiner*—George F. Mautz
*Attorney, Agent, or Firm*—Ira Milton Jones

[57] ABSTRACT

An unorthodox cross-sectional shape for the bobbin or mandrel upon which wire is wound makes possible high speed production of non-circular perfect layer coils.

7 Claims, 14 Drawing Figures

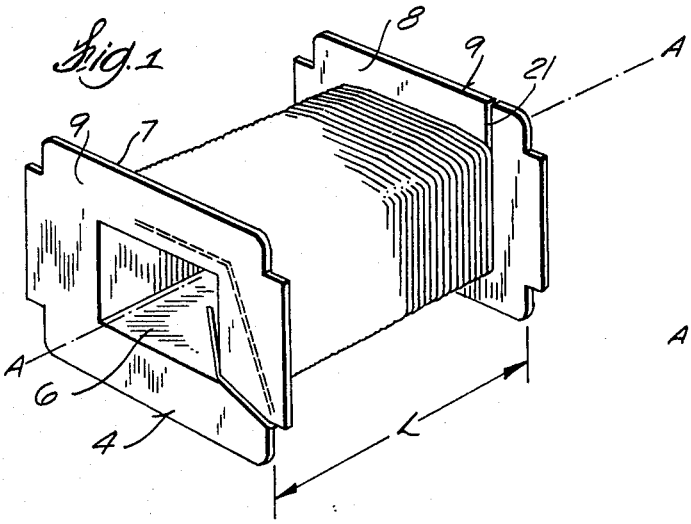
Fig. 1
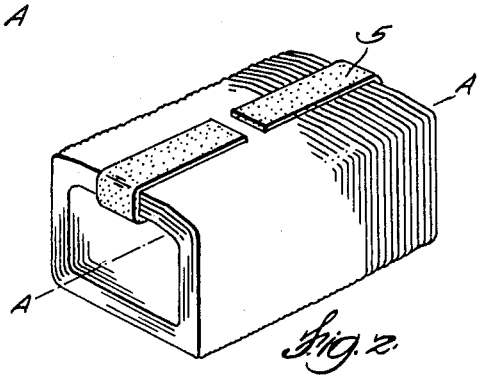
Fig. 2
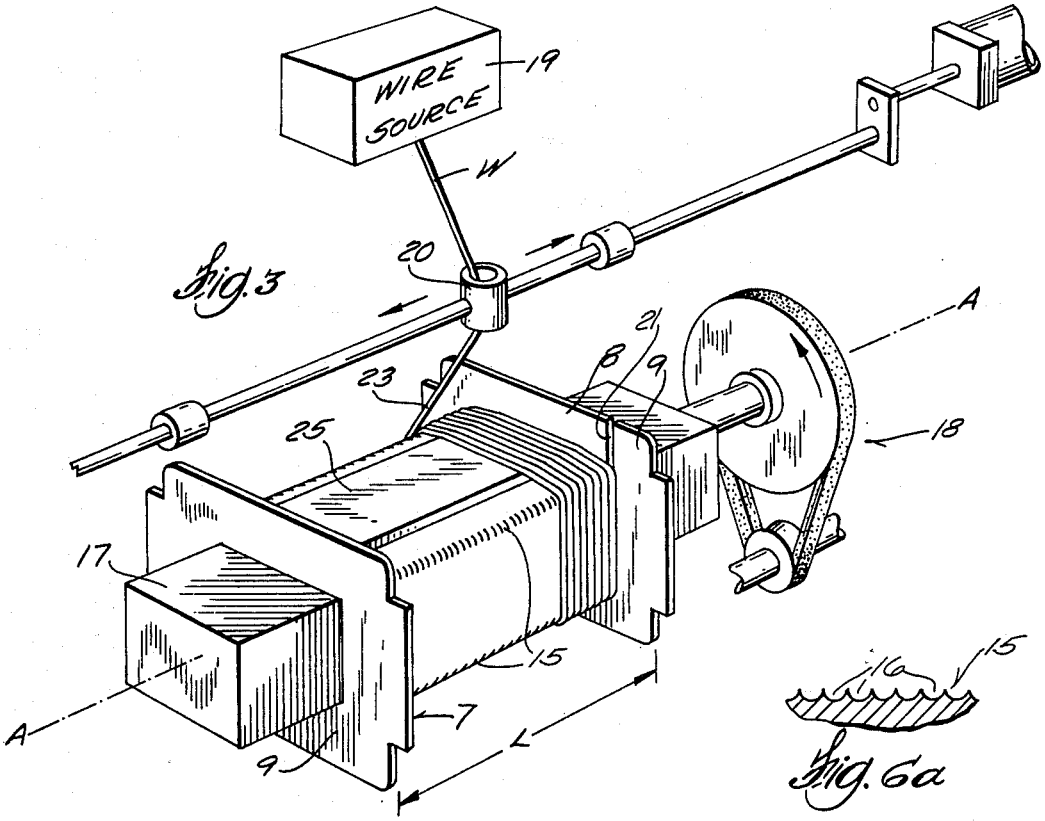
Fig. 3
Fig. 6a
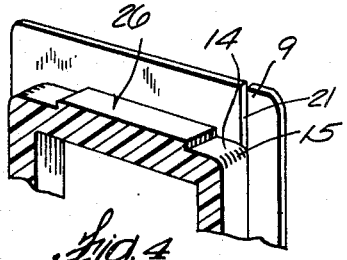
Fig. 4
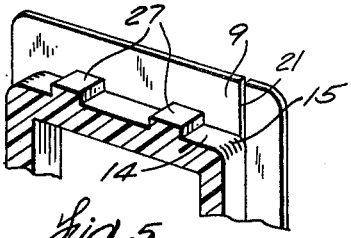
Fig. 5
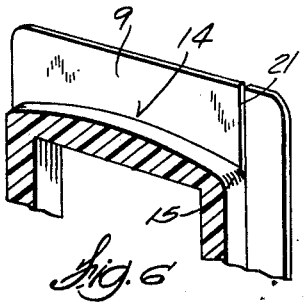
Fig. 6

Fig. 7
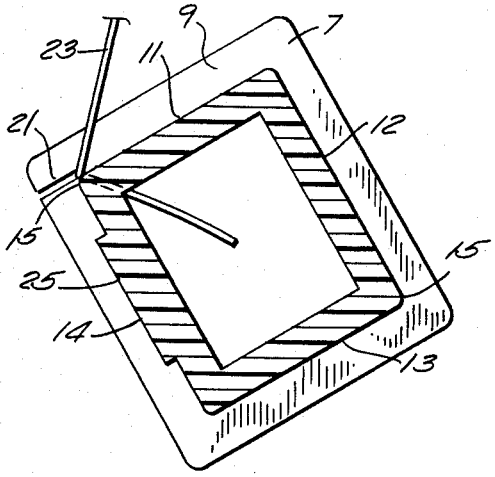
Fig. 8
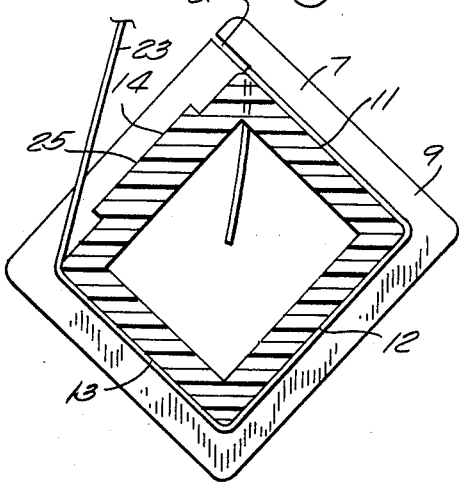
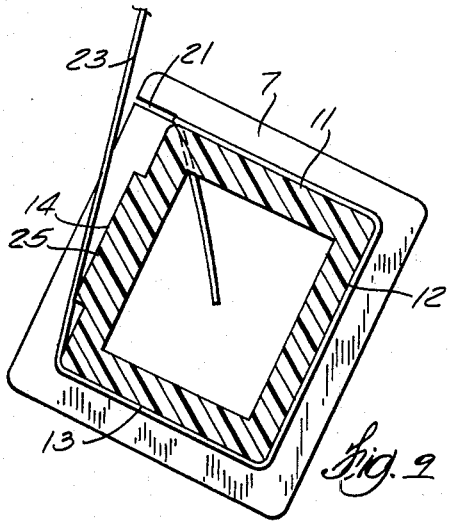
Fig. 9
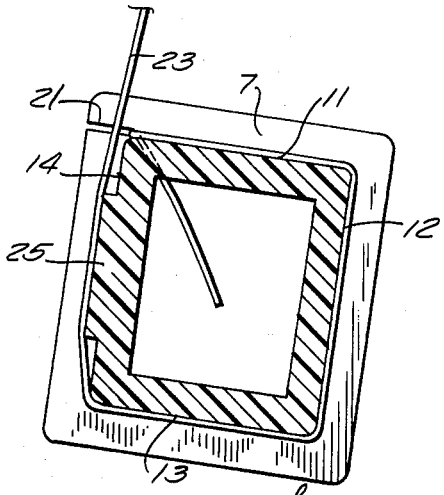
Fig. 10
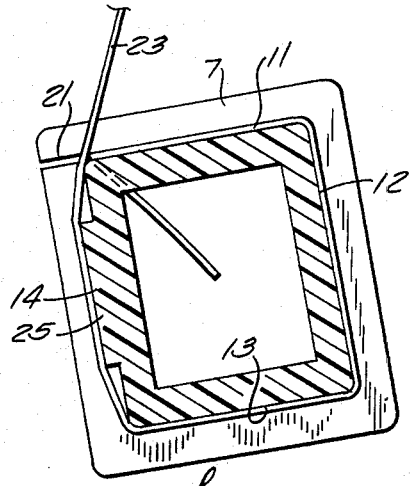
Fig. 11
Fig. 12
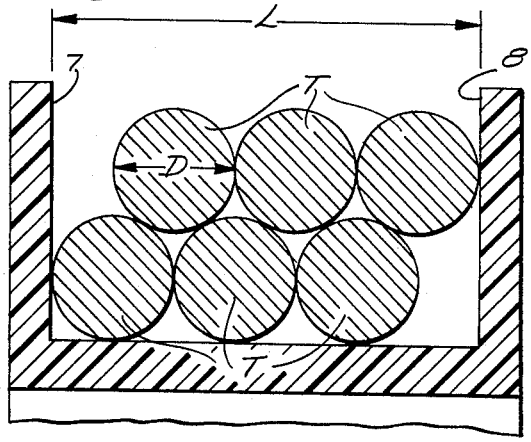

NON-CIRCULAR PERFECT LAYER ELECTRICAL COILS

This invention relates to apparatus for winding electrical coils, and is more particularly concerned with apparatus which makes possible the high-speed winding of so-called perfect layer coils, every turn of which is substantially orthocyclic.

Electrical coils intended for certain applications must be wound in such a manner as to achieve the utmost compactness, with every turn of the coil having the shortest possible developed length of wire. For example, a winding for the center leg of an E-core transformer or reactor must be extremely compact when there is a minimum of space between the legs of the E, in order to get the greatest possible number of turns of a given size wire into the available space between the core legs.

The most compact coil winding is a so-called perfect layer coil, in which, as distinguished from a random wound coil, the turns of the coil are laid in smooth, regular layers. Where the geometry of the winding can be controlled to achieve the perfect layer configuration, the maximum potential difference between contiguous turns is thereby established for a given voltage across the coil as a whole. It is not necessary, therefore, to interleave paper between layers of the winding, as is customary with random windings to assure separation of points of possible high voltage difference. Elimination of the paper interleaf can result in reducing the length of wire required for a given number of turns by from 10% to 20%, and this of course enables the coil to fit into a smaller space. In addition to its advantages in copper economy and in adaptability to tightly limited space situations, a perfect layer coil is more efficient electrically than any other type, has nearly perfect electrical and mechanical uniformity from coil to coil, and impregnates evenly.

The difference between a random wound coil and a perfect layer coil is apparent if one visualizes a coil of rather heavy wire wound around a cylindrical core or form. If the innermost layer of such a coil is wound as a helix that "advances" regularly in one axial direction, the next layer must advance in the opposite direction. Each turn of the second layer should cross one turn of the first layer, and if the second layer were wound as a perfect helix, such crossing would take place at a steady rate of advance all around the turn. But the second layer cannot be wound as a perfect helix, owing to the fact that the regularity of its advance is continuously disturbed by the tendency of the wire to lie in the grooves between adjacent turns of the first layer. Of course the wire of the second layer is lying at the wrong angle to the coil axis when it follows a groove of the first layer. It therefore follows such a groove for some distance, then cuts across the wire of the first layer to follow another groove for a distance. These crossover points occur at more or less random intervals. The irregularities become greater as the winding of the coil proceeds, and they soon reach a point where it is no longer possible to distinguish one layer from another. Such a coil is thus said to be random wound. The interleaving of paper between the layers prevents the layers from interfering with one another in this manner, in addition to providing insulation between adjacent turns that may be at high voltage to one another; but of course the paper interleaf has the disadvantages pointed out above.

Since the turns of the first and second layers cannot accurately lie at a small angle to one another, the irregularity in the winding could be avoided if the angle between the windings of the two layers could be reduced to zero, so that the first and second layers could constitute interlocking helices. In practice this is of course impossible, but a close approximation of the ideal condition is obtained if the major portion of each turn of the winding is disposed in a plane normal to the axis of the coil. This major portion of each turn can be described as orthocyclic. In each turn there is then a small jog or crossover zone, occupied by a relatively short length of the wire comprising the turn, and the crossover zones of all of the turns are in substantially axial alignment with the starting point of the first turn. If the crossover zones of the second layer are superimposed upon those of the first, with the major portion of each turn of the second layer likewise orthocyclic, then the orthocyclic portions of the turns of the second layer lie in grooves defined by the orthocyclic portions of turns of the first layer, and perfect layer winding of the entire coil can be attained.

In practice, the attainment of perfect layer winding is more important with noncircular coils than with circular ones, because applications that require square or rectangular coils are more likely to impose the space limitations that call for the advantages of perfect layer winding. A noncircular coil is wound on a form having four substantially flat sides and four lengthwise extending corners. The corners are usually rounded to a small radius. A perfect layer coil wound on a noncircular form has each of its turns disposed orthocyclically around three sides of the form, and every turn has a crossover portion that overlies the fourth side.

Noncircular perfect layer coils have been produced heretofore, but their production has required special and rather costly winding equipment and each coil has had to be wound rather slowly. Hence the use of perfect layer coils has been limited to the relatively few applications where special requirements justify their substantially higher cost.

It is evident, however, that perfect layer coils possess several advantages that would make them desirable for most applications in which random wound coils are now used, provided a perfect layer coil could be produced at a cost comparable to the cost of a random wound coil.

With the foregoing considerations in mind, it is a general object of this invention to provide simple and inexpensive apparatus which makes possible the production of noncircular perfect layer coils at a cost substantially equal to that of equivalent random wound coils.

Another and more specific object of this invention is to provide apparatus for high speed production of noncircular perfect layer coils with the use of a winding machine of a conventional type heretofore used for production of random wound coils.

Heretofore it has been accepted that the wire guide of a winding machine to be employed for winding noncircular perfect layer coils had to have an intermittent, incremental movement; and the apparatus for imparting such non-steady movement to the wire guide was of course complicated and expensive to build.

By contrast, it is another specific object of this invention to provide apparatus for high speed winding of noncircular perfect layer coils with a winding machine that has a wire guide which moves back and forth at a steady rate in directions parallel to the axis of the coil being wound.

A further object of this invention is to provide a winding form which can be produced very inexpensively, and which can be either a bobbin or a winding mandrel, whereby noncircular perfect layer coils can be produced at high speed.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and in which:

FIG. 1 is a perspective view of a finished perfect layer bobbin type coil made in accordance with this invention;

FIG. 2 is a perspective view of a finished perfect layer coil made in accordance with this invention but instead of being wound on a bobbin was wound on a collapsible mandrel and taped to hold it together;

FIG. 3 is a more or less diagrammatic view, in perspective, illustrating how the coils are wound;

FIGS. 4, 5 and 6 are similar fragmentary sectional views through a bobbin illustrating three different ways in which an essential feature of this invention is incorporated in the bobbin;

Figure 13:
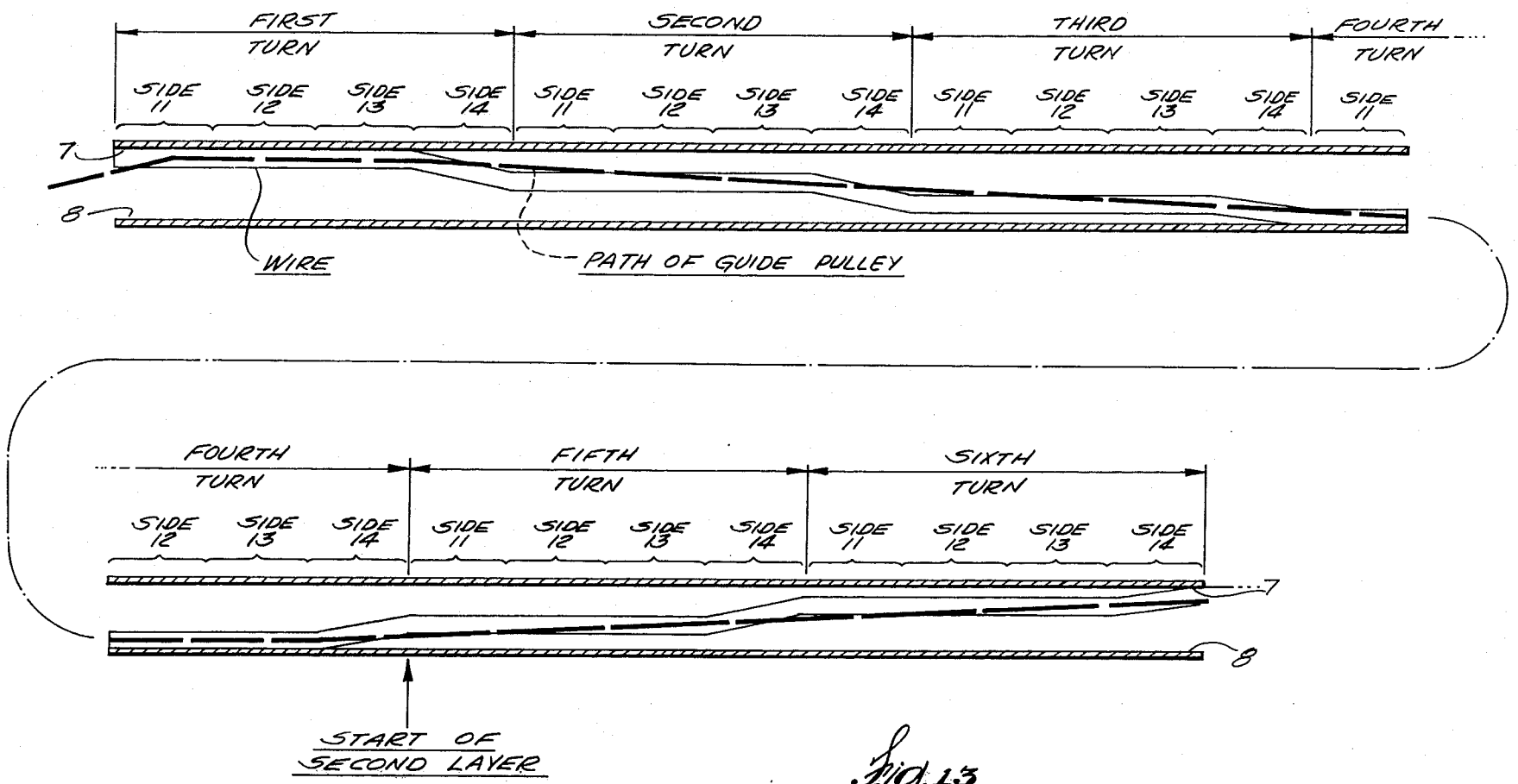

FIG. 6*a* is an enlarged sectional view illustrating a detail of the bobbin;

FIGS. 7 and 8 are sectional views in perspective through the bobbin of FIG. 4, illustrating the starting stages in the winding of the first layer of the coil;

FIGS. 9, 10 and 11 are sectional views similar to FIGS. 7 and 8 but not in perspective illustrating how the novel cross sectional shape of the bobbin facilitates the necessary crossover of the wire from the plane of the first turn to the plane of the next adjacent turn;

FIG. 12 is a diagrammatic view illustrating the relative disposition of the first and second layers of wire onto a bobbin or mandrel; and FIG. 13 is a diagrammatic view illustrating the coaction between the core of a bobbin or mandrel and the movable wire guide in winding wire thereon.

Referring now to the accompanying drawings, FIGS. 1 and 2, illustrate two forms of the non-circular perfect layer coil with which this invention is concerned. The coil of FIG. 1 is wound on a bobbin 4 that constitutes a permanent part of the finished coil, to serve for its protection and insulation as well as for its support. The coil of FIG. 2 has no bobbin, having been wound on a collapsible mandrel from which the coil is removed at the completion of the winding operation. As is customary the mandrel-wound coil is held together by a band of tape 5 or the like. In either case, the wire forming the coil is wound around a coil support that is rectangular or square in cross section, and which in the case of the coil wound onto a bobbin (FIG. 1) is the tubular body 6 of the bobbin.

In both instances, also, the coil is wound between axially spaced guide surfaces that lie in planes normal to the axis A—A of the coil. In the case of the bobbin-wound coil these guide surfaces are the opposing inner faces 7 and 8 of flanges 9 at opposite ends of the tubular body 6. The distance L between the guide surfaces, i.e. the opposing flange faces 7 and 8 in the case of the bobbin-wound coil, depends upon the diameter D of the wire to be wound onto the form, and the number of turns T of that wire in each layer of the finished coil. Specifically, the distance L is identified by the equation: $L = D\,(T + \frac{1}{2})$.

This relationship is graphically illustrated in FIG. 12 which is drawn to a greatly exaggerated scale, and for sake of space conservation, shows only the initial and second layers of a three turn coil.

Although the invention is equally as applicable to the winding of coils on mandrels as on bobbins, the former technique is not included in the disclosure. Moreover, those skilled in the art will have no difficulty understanding how the invention applies to the winding of coils on a mandrel.

As already noted, the tubular body 6 of the bobbin may have either a rectangular or a square cross section, but in either case it has four outer side surfaces 11, 12, 13 and 14 that extend parallel to the coil axis from one to the other of the flanges 9. With an important exception discussed below, each of those side surfaces is flat.

The side surfaces are connected by corners 15 that are rounded on a small radius. Having regard to the direction of winding, these corners define, for each side, a leading edge which is first contacted by a wire being wound onto the bobbin and a trailing edge which is engaged by the wire after it has been laid across the side.

The corners are provided with wire confining grooves 16 of arcuate cross-section, shown at an exaggerated scale in FIG. 6*a*. Each groove around a corner has its plane of longitudinal symmetry coinciding with that of a groove around each of the other three corners, and all such planes of symmetry are normal to the coil axis A—A.

In winding a coil onto the bobbin, the bobbin is first slipped onto a spindle 17 diagrammatically illustrated in FIG. 3, and then an end portion of the wire W is secured to the bobbin and the bobbin is rotated about its axis by suitable drive means 18. As the bobbin turns, the wire is drawn from a supply thereof diagrammatically illustrated at 19 in FIG. 3, and is guided in its application onto the bobbin by a reciprocating wire guide 20 also diagrammatically illustrated in FIG. 3.

For the moment, however, let it be assumed for the purposes of explanation that the wire is to be wound turn-by-turn onto the bobbin. Let it also be assumed, for the sake of simplicity, that the coil is to have three turns per layer as shown in FIG. 12. An end portion of the wire is secured to the bobbin in any suitable manner as by confining it in a notch 21 in the flange 9 that provides the end surface 7. This notch is so located that a point on the wire that represents the start of the coil proper is contiguous to the end surface 7 and near the trailing edge of the side surface 11, see FIG. 8. From that point the wire is laid across the side 11, around the corner 15 that defines the trailing edge of the side 11 in the groove 16 nearest the end surface 7, and then successively across the sides 12 and 13, always contiguous to the end surface 7 and passing around each corner in the groove nearest that end surface. The first (approximately) three-quarters of the first turn is then disposed orthogonally to the coil axis. Across the fourth side surface 14, however, the wire must leave the plane containing the stretches of wire extending across the sides 11, 12 and 13, and make a jog or offset in order to enter the second groove in its trailing edge.

If the wire has the proper offset in crossing the side 14 of the form, the first three-quarters of the second turn can be wound to lie smoothly contiguous to the orthocyclic portions of the first turn and will then likewise be orthocyclic. Again, the second turn will have a non-orthocyclic crossover portion overlying the side surface 14.

The third turn will similarly have orthocyclic portions overlying the sides 11, 12 and 13. Since for purposes of illustration the coil being wound has only three turns, those orthocyclic portions of the final turn are spaced one-half a wire diameter from the adjacent end surface 8. The crossover portion of the final turn overlying side surface 14, jogs laterally by about half a wire diameter but also jogs outwardly (away from the coil axis), so that the continuation of the wire across side 11 which forms the beginning of a second layer, can lie in the groove between the flange surface 8 and the final turn of the first layer. Each turn of the second layer again has orthocyclic portions overlying the sides 11, 12 and 13, disposed in the grooves between turns of the first layer, and has crossover portions overlying the side 14.

In the actual commercial production of coils, the wire guide 20 usually comprises coacting pulleys with which the wire has sliding (or rolling) engagement as the wire is wrapped around the bobbin. The orientation of the stretch 23 of wire that extends between the wire guide and the bobbin is critical, which is to say that the wire guide must be properly located in relation to the bobbin during each phase of its rotation. Heretofore it has been assumed that in the winding of a non-circular perfect layer coil the wire guide had to remain stationary during those phases of each rotation in which orthocyclic portions of a turn were being laid onto three sides of the bobbin, and had to be moved laterally through a distance equal to the wire diameter during the time that the crossover position of the winding was being laid onto the fourth side.

By contrast, the present invention is based upon a recognition that with a proper bobbin and with proper positioning of the wire guide, the wire guide can be moved steadily at a rate which bears a fixed relationship to the rate of rotation of the bobbin, through the winding of all but the endmost turns of each layer. Utilizing the present invention, it is thus possible to actuate the wire guide by means of a more or less conventional cam drive; and in fact the wire guide and its driving mechanism can be those of a heretofore conventional coil winding machine. Accordingly, disclosures of a specific wire guide and of the driving mechanism therefor are not needed for an understanding of the invention by those skilled in the art.

FIG. 13 is a developed view of a wire laid onto the side surfaces of a bobbin (or mandrel type coil form) to form the first two layers of a three-turn perfect layer winding, with the wire shown in relation to the position of the wire guide from instant to instant as it moves back and forth during the rotation of the bobbin — the path of the wire guide being identified by the broken line. For simplicity, the bobbin is assumed to have a square cross-section, with all of its side surfaces of equal width.

During about the first quarter turn of the bobbin the wire overlies the side 11 but is not yet in contact therewith, and the wire guide moves from a previous position at the end of its traverse at which it is nearest the end surface 7. Just as the bobbin rotates to the position at which the wire contacts the side 11, the wire guide reaches its endmost position, in which it disposes the wire stretch 23 in a plane that is exactly normal to the coil axis and in which the wire is contiguous to the end surface 7. The wire is therefore placed directly into the endmost groove 16 in the corner 15 between sides 11 and 12. The wire guide dwells in this position as the wire is laid across sides 12 and 13, to insure that the first three-quarters of the first turn are orthocyclic.

As the bobbin begins the fourth quarter of its first rotation, the wire guide begins its movement parallel to the coil axis, in the direction away from the end surface 7 and towards the opposite end surface 8. Such movement takes place at a steady rate equal to one wire diameter per complete rotation of the bobbin. By the time the trailing edge of the crossover side 14 comes up to meet the wire, the wire guide has moved one-quarter of a wire diameter away from its end position. Of course this amount of travel of the wire guide is less than the required lateral displacement of the wire across the side 14, and therefore the wire that is being laid tends to climb up onto the already-laid wire of the first turn as the wire is drawn around the trailing edge of the side 14. As rotation of the bobbin continues, tension in the stretch 23 of the wire produces a force component which tends to draw the wire downwardly along and around the rounded surface of the already-laid wire and into firm engagement with the side surface 14 of the form. The position of the wire guide during this phase of the rotation cycle thus causes the newly-laid wire to slide down off of the already-laid wire and into its destined position occupying the second groove 16 in the trailing edge 15 of side 14.

During the next three quarters of a turn of the bobbin, the wire guide is so positioned that it continues to lay the oncoming wire in slightly overlapping relationship to the already-laid wire, to assure that across the sides 11, 12 and 13 the wire will be directly contiguous to the first turn as the rotation progresses and the wire guide comes more and more nearly into alignment with the position that the wire being laid is intended to assume, until, at the second three-quarter turn point the stretch of wire 23 again lies in a plane which is exactly normal to the coil axis and which coincides with the plane of symmetry of the second groove in the corner that defines the leading edge of the crossover side surface 14.

In general, therefore, the movement of the wire guide must be at a rate equal to one wire diameter per rotation of the coil form, and must be so timed as to align the wire accurately with its intended groove 16 as the wire engages the leading edge of the crossover side 14.

It will be apparent that the rather small axial offset between the laid wire and the wire being laid onto the crossover side is critical. A variation of this offset in the wrong direction, by even a small fraction of a wire diameter, could cause the wire being laid to snap down onto the wrong side of the already-laid wire, with the result that the newly-laid wire would cross the already-laid wire and drop into a groove between existing turns. If this happened, the end result would not be a perfect layer coil. It is because of this danger that a steadily moving wire guide — as distinguished from an intermittently moving one — has heretofore been regarded as impracticable for high speed production of perfect layer coils.

At sufficiently slow rotational speeds, and with reasonable stability of the rotating bobbin supporting spindle and very accurately controlled motion of the wire guide, it was possible to wind a perfect layer coil onto a conventional bobbin or mandrel. But if the bobbin or mandrel was driven at a rotational speed high enough for reasonably economical production, the resulting whipping of the wire stretch 23 as it successively wrapped around the corners and onto the flat sides of the bobbin or mandrel became vigorous enough to induce a substantial amount of lateral vibration in the wire. That vibration plus the fact that perfect positioning of the wire guide at any particular stage of its movement is not necessarily certain, made crossovers so erratic, that desirably high speed production of perfect layer coils, was considered impossible.

The present invention proceeds from a recognition that some lateral deviations of the wire stretch 23 are inevitable in the high-speed winding of a non-circular coil, and provides means for preventing such deviations from disrupting the desired relationship between the already-laid wire overlying the crossover side 14 and the wire being laid onto that side.

Specifically, the invention comprises the provision of wire support means 25 on the crossover side surface 14 of the bobbin (or mandrel) by which the stretches of wire laid onto this side are given a slightly convex profile, which profile is uniform all the way from one to the other flange 9.

FIGS. 4, 5 and 6 illustrate three different ways in which the wire support means 25 may be provided. In FIG. 4, it comprises a single central raised portion or land 26 on the side 14, extending from end to end thereof, and having its longitudinal edges in spaced parallel relation to the leading and trailing edges of the side 14. In FIG. 5, the side surface 14 is for the most part flat, like the other three side surfaces, but has a pair of lands or ridges 27 that extend along it for its full length, and which are spaced from, and parallel to, its leading and trailing edges respectively. In FIG. 6, the side surface 14 is curved on a large radius about an axis of curvature which is parallel to the coil axis A—A.

In each instance, the middle portion of the side surface 14 for the full length thereof provides a wire support that is raised a little above a plane that is tangent to both the rounded leading and trailing edges of the crossover side 14. By virtue of this unorthodox cross-sectional shape of the crossover side 14, the unsupported length of wire being laid across the side 14 as the successive turns of the first layer of the coil are formed thereon, is significantly shorter than would be the case with a conventional wholly flat profile for the crossover side 14.

FIGS. 9, 10 and 11 illustrate how the provision of the raised medial portion of the crossover side surface reduces the likelihood of objectional vibration of the wire as it lays itself onto that surface. As there shown, the wire comes into engagement with the crossover surface a little at a time in increments that are shorter than the width of the crossover surface. Stated in another way, the point of contact of the wire with the crossover surface shifts progressively from its leading edge to its trailing edge as the wire lays itself onto the crossover surface. By contrast, if the crossover surface were flat, contact between the wire and that surface would occur substantially simultaneously at all points along a length of wire equal to the width of the surface. It was that consequence of the conventional non-circular bobbin or mandrel that made high speed perfect layer winding impossible.

Another observation of significance to an explanation of why the unorthodox cross-sectional shape of the crossover side of the bobbin or mandrel has eliminated the bottle neck that constrained perfect layer coil winding to low production speeds, is that when the crossover surface has the contour of this invention, the portion of the wire stretch which is moving onto that surface at any given instant is always closely adjacent to a portion of the immediately preceeding turn. As a result the oncoming portion of the wire is steadied and guided by the already-laid wire just ahead of it.

The degree of departure from true flatness that must be provided by the raised central portion of the side surface 14 is a relatively small one, not great enough to effect any substantial increase in the amount of wire needed for a coil. The exact amount of the departure from flatness is not highly critical, although in a general way it depends upon the diameter of the wire being wound and the distance across the crossover side 14 of the form. For a bobbin or mandrel of average size and shape, the rise or departure from flatness can be on the order of one-half to one times the wire diameter.

The raised medial portion of the crossover side 14, not only assures that the first layer of the coil will be perfect, but also has a significantly ameliorating affect upon the formation of succeeding layers of the coil.

Extensive tests have demonstrated that this invention, despite the relatively slight structural change it has made over prior non-circular bobbins and mandrels, makes it possible for the first time to wind non-circular perfect layer coils at very high production speeds, and thus enables such coils to be produced at a cost which compares favorably with that of equivalent random wound coils.

Those skilled in the art will appreciate that the invention can be embodied in forms other than as herein disclosed for purposes of illustration.

The invention is defined by the following.

I claim:

1. A winding form for a non-circular coil, said form having an axis and a pair of flanges which provide opposing flat end surfaces that are normal to said axis, and having a polygonal coil supporting portion which extends lengthwise between said end surfaces, is symmetrical to said axis and has a plurality of sides connected by small radius corner junctions that are parallel to said axis and define leading and trailing longitudinal edges of the sides relative to rotation of the winding form about its axis, said form being rotatable about its axis to wind a wire onto it, with the wire first contacting the leading edge of each side and then being laid across the side to the trailing edge thereof, and said winding form having the following characterizing features which enable a wire to be wound onto it at high speed and in smooth, regular layers of closely adjacent turns, with each turn between the ends of a layer having an orthocyclic portion that extends across all but one of said sides and lies in a plane normal to the axis and having a crossover portion connecting it to the next adjacent turn and that lies on said one side, whereby said one side constitutes a crossover side:

A. each of said edges having equispaced grooves in which the wound wire of an innermost layer is received and which cooperate to establish the position and orientation of said orthocyclic portions of each turn of said innermost layer;

B. every one of the sides of the winding form except its crossover side having no portion thereof projecting outwardly beyond a plane tangent to its round edges;

C. means on the crossover side defining a wire support that extends longitudinally of the winding from one to the other of said end surfaces and projects outwardly from a plane which is tangent to the round edges of said crossover side by a distance that is uniform all along its length; and D. wire securing means on said winding form for securing thereto an end portion of a wire to be wound thereon, said wire securing means being so located as to establish a point on the wire in contiguity to one of said end surfaces and to said coil supporting portion at a location adjacent to the trailing longitudinal edge of its crossover side.

2. The winding form of claim 1, further characterized in that said form comprises a bobbin in which the coil supporting portion and the pair of flanges constitute a unitary integral structure, and wherein said means that defines the wire support on the crossover side is spaced from both edges of said side.

3. The winding form of claim 2, wherein said means defining a wire support on the crossover side of the coil supporting portion is integral therewith.

4. The winding form of claim 2, wherein the crossover side of the coil supporting portion is flat except for the presence thereon of said means that defines said raised wire support, and wherein said means is a rib projecting above said otherwise flat crossover side.

5. The winding form of claim 1, wherein the coil supporting portion of the winding form has four sides, three of which are flat and the fourth being the crossover side and having the wire support-forming means thereon.

6. A method of winding a wire coil on a polygonal winding form having a plurality of sides that are disposed symmetrically to the axis of the winding form, each side having leading and trailing edges relative to rotation of the winding form about its axis, said edges being defined by the junctions of the sides with their respective adjacent sides, said winding form also having axially spaced flanges to define the ends of the coil, said method producing a perfect layer coil in which the coil portions at all but one side of the winding form are disposed orthogonally to the coil axis and the crossover from one to the next of the successively applied turns of the coil is at said one side of the winding form which therefore constitutes the crossover side of the winding form, said method being characterized by:

A. providing the crossover side of the winding form with a longitudinally extending wire support that extends from one to the other of the flanges of the winding form and projects outwardly from a plane containing the edges of the crossover side by a distance that is uniform all along its length;

B. confining the winding form against axial movement and to rotation in one direction about its axis while maintaining its axis fixed and parallel to a defined path of a reciprocable wire guide;

C. securing to the winding form, at a point thereon adjacent to one of its flanges and near the leading edge of its crossover side, the free edge of a length of wire that extends from the wire guide;

D. with the wire guide stationary at a defined location in which it holds said length of wire in a plane normal to the axis of the winding form and directly contiguous to said one flange, rotating the winding form in the direction to which it is confined to thereby cause wire of said length thereof to lay itself successively across all but the crossover side of the winding form and in direct contiguity to said one flange;

E. continuing rotation of the winding form to cause said wire to wrap itself around the leading edge of the crossover side of the bobbin and lay itself transversely across said crossover side with the point of contact between the wire and the winding form being shifted progressively from the leading edge to the trailing edge of the crossover side by reason of the presence of the wire support thereon;

F. substantially at the instant the wire wraps itself around the leading edge of the crossover side of the winding form, initiating a steady constant movement of the wire guide along its defined path from its aforesaid defined position towards the other flange of the winding form at a rate of one wire diameter per complete revolution of the winding form; and G. continuing said rotation of the winding form and said movement of the wire guide to thereby lay successive turns of the coil onto the winding form until the first layer of the coil has been completed.

7. The method of claim 6, further characterized by:

A. at the completion of the first layer of the coil and with the orthocyclic portion of its last turn spaced one-half the wire diameter from the adjacent winding form flange, and by said rotation of the winding form and said movement of the wire guide, causing the crossover portion of that last turn to seat itself in the space between said flange and the side of the portion of said last turn that is wrapped around the trailing edge of the crossover side of the winding form;

B. substantially at the instant the wire wraps itself around the trailing edge of the crossover side, stopping the movement of the wire guide at a definite position in which it holds the length of wire extending therefrom in a plane normal to the axis of the winding form and directly contiguous to said adjacent flange;

C. while the wire guide is at said definite position, continuing rotation of the winding form to effect orthocyclic disposition of the wire across all sides of the winding form except its crossover side; and D. then at substantially the instant the wire wraps itself around the leading edge of the crossover side, initiating steady and constant movement of the wire guide along its defined path but in the opposite direction, at a rate of one wire diameter per complete revolution of the winding form.

* * * * *